US005820358A

United States Patent [19]

Kushida et al.

[11] Patent Number: 5,820,358

[45] Date of Patent: Oct. 13, 1998

[54] CLEARANCE MEANS TO PREVENT FUEL LEAKAGE IN A RADIAL PISTON PUMP

[75] Inventors: Takeo Kushida; Fujio Aoki; Takayuki Ikeda; Koichiro Futamase; Tomoharu Sato; Hideya Kikuchi; Ken Sato; Nobuo Aoki; Katsuhiko Tsukazaki, all of Saitama Prefecture, Japan

[73] Assignee: Zexel Corporation, Tokyo, Japan

[21] Appl. No.: 562,250

[22] Filed: Nov. 22, 1995

[30] Foreign Application Priority Data

Nov. 25, 1994 [JP] Japan ..... 6-314255

[51] Int. Cl.[6] ..... F04B 17/00

[52] U.S. Cl. ..... 417/420; 417/373

[58] Field of Search ..... 417/373, 420

[56] References Cited

U.S. PATENT DOCUMENTS

| | | | |
|---|---|---|---|
| 4,722,661 | 2/1988 | Mizuno | 417/420 |
| 5,066,200 | 11/1991 | Ooka | 417/63 |
| 5,127,796 | 7/1992 | Nakao et al. | 417/420 |
| 5,165,868 | 11/1992 | Gergets et al. | 417/366 |
| 5,464,333 | 11/1995 | Okada et al. | 417/420 |
| 5,630,708 | 5/1997 | Kushida et al. | 417/420 |

FOREIGN PATENT DOCUMENTS

| | | |
|---|---|---|
| 60-216081 | 10/1985 | Japan . |
| 64-367 | 1/1989 | Japan . |
| 3-175158 | 7/1991 | Japan . |
| 417795 | 1/1992 | Japan . |
| 5-256252 | 10/1993 | Japan . |

*Primary Examiner*—Timothy Thorpe
*Assistant Examiner*—Cheryl J. Tyler
*Attorney, Agent, or Firm*—Ostrolenk, Faber, Gerb & Soffen, LLP

[57] ABSTRACT

A pump for low-viscosity fuel comprises a pump shaft 6 installed in a pump housing 2, 3, 4 and divided into a drive-side shaft 6A and a driven-side shaft 6B, a partition 12 provided between the drive-side shaft and the driven-side shaft of the pump shaft to prevent leakage of fuel from the housing, and a magnetic coupling 13 for transferring torque from the drive-side shaft to the driven-side shaft of the pump shaft through the partition, the magnetic coupling being disposed such that a first clearance C1, D1 between the magnetic coupling and the partition is larger than a second clearance C2, D2 between the magnetic coupling and the pump housing. When wobble occurs in the pump shaft owing to wear of the sliding contact portions thereof, the magnetic coupling makes contact with the pump housing before contacting the partition, thereby enabling the rotation of the pump shaft to be stopped before fuel leakage occurs.

11 Claims, 6 Drawing Sheets

CLEARANCE MEANS TO PREVENT FUEL LEAKAGE IN A RADIAL PISTON PUMP

BACKGROUND OF THE INVENTION

1. Field of the Invention

This invention relates to a pump for low-viscosity fuel, more particularly to a radial piston pump or other type pump for low-viscosity fuel constituted as a high-pressure gasoline pump whose pump shaft is driven by use of a magnetic coupling.

2. Prior Art

Improvement of the combustion efficiency of the internal combustion engines used in vehicles and the like is widely accepted as necessary for reducing the pollution caused by exhaust gases, as well as for preserving natural resources. An effective way of improving combustion efficiency in a gasoline engine is to promote fine atomization of the fuel spray by delivering the gasoline under high pressure. Fine atomization is also required in the case of alcohols and other such alternative fuels (referred to simply as "alcohols" in this specification) now being considered for use in internal combustion engines, since alcohols have poor cold starting characteristics.

Since the delivery pressure of 3–4 $Kgf/cm^2$ of ordinary fuel pumps is insufficient for achieving the required degree of atomization, there is a need for a high-performance pump capable of producing a delivery pressure of several tens of $Kgf/cm^2$.

As a type of pump suitable for this purpose, the radial piston pump is a strong candidate from the aspects of performance and efficiency. The radial piston pump is described, for example, in Japanese Patent Disclosure No. Sho 60-216081.

The prior-art radial piston pumps, such as that taught by Japanese Patent Disclosure No. Sho 64-367, have generally been used as hydraulic pumps, namely as means for delivering pressurized high-viscosity oil (viscosity≧30 cst). No problems arise regarding the performance of the prior-art radial pumps so long as they are used with high-viscosity oil. The viscosity of alcohols is, however, on the order of 0.5 cst, which is extremely low.

An attempt to adapt a conventional radial piston pump for high-pressure delivery of a fuel having such low-viscosity property simply by modifying the cylinder block from the rotary type to the stationary type or to the stationary cylinder type in which only the pistons reciprocate is doomed fail because the pump will not be able to maintain its performance. This is because such a modification does not overcome such problems as, for example, dissolving and dilution of the grease sealed in the drive shaft bearing by the low-viscosity fuel and galling and seizing occurring between the pistons and the barrels or between the eccentric cam and the ends of the pistons.

The prior-art radial piston pump is thus incapable of smoothly and stably delivering low-viscosity fuel under high pressure.

For overcoming these problems, the assignee previously developed a practical radial piston pump capable of stably pumping low-viscosity fuels such as gasoline and alcohols even at high pressures exceeding several tens of $Kgf/cm^2$, without damage to the bearing portions or occurrence of galling and seizing at the piston sliding surfaces. This pump is described in detail in Japanese Patent Disclosure No. Hei 3-175158.

However, this radial piston pump for low-viscosity fuel was found to have a problem regarding the seal structure for preventing leakage of the low-viscosity fuel. Specifically, the structure was found to be incapable of maintaining a perfect seal in actual operation owing to the rotation of the pump drive shaft relative to the seal members.

For overcoming this problem, the assignee developed a radial piston pump for low-viscosity fluid in which power transmission and seal performance are enhanced by dividing the pump shaft into a drive-side shaft and a driven-side shaft, providing a partition between the drive-side shaft and the driven-side shaft for shutting off the interior of the pump housing from the exterior, and coupling the two shaft portions by a magnetic coupling straddling the partition.

This radial piston pump is described, for example, in Japanese Patent Disclosure No. Hei 5-256252 and will be explained with reference to FIGS. 7 and 8, in which it is designated by reference numeral 1.

FIG. 7 shows an overall sectional view of the radial piston pump for low-viscosity fuel 1. It comprises a cover 2 (first pump housing member), a pump housing member 3 (second housing member), a flange 4 (third housing member), a leaf valve member 5 disposed between the cover 2 and the pump housing member 3 and a pump shaft 6.

The cover 2 is formed with an intake passage 7, an overflow passage 8 and a discharge passage 9 and is fastened to the pump housing member 3 by bolts 10. In addition, the pump housing member 3 and the flange 4 are fastened together by housing bolts 11.

The pump shaft 6 is divided into a drive-side shaft 6A and a driven-side shaft 6B which are located on opposite sides of a partition 12 made of a nonmagnetic material such as stainless steel (SUS) and linked by a magnetic coupling 13 straddling the partition 12.

The magnetic coupling 13 comprises a drive-side coupling member 14 and a driven-side coupling member 15. The drive-side coupling member 14 consists of a drive-side yoke 14A and a drive-side magnet 14B and is fixed to the drive-side shaft 6A, while the driven-side coupling member 15 consists of a driven-side yoke 15A and a driven-side magnet 15B and is attached to the driven-side shaft 6B by a bolt 16.

The drive-side shaft 6A is rotatably supported by a ball bearing 17 and is driven by an engine or the like (not shown).

The driven-side shaft 6B is formed at its center portion with an eccentric cam 6C and at its opposite ends with a cover-side support section 6D and a housing-side support section 6E whose axes coincide with each other.

The cover-side support section 6D is rotatably supported via a first roller bearing 19 and a washer 18 within a first bearing bush 20 force-fitted in a hole extending from the cover 2 into the pump housing member 3.

The housing-side support section 6E is rotatably supported via a second roller bearing 23 and washers 21, 22 at the opposite ends thereof within a second bearing bush 24 force-fitted into a hole at the other end of the pump housing member 3.

A retainer 26 is fastened to the exterior of the pump housing member 3 by bolts 25 for holding the second bearing bush 24 between itself and the pump housing member 3. With this arrangement, the second bearing bush 24 can be prevented from falling out even when inserted with minimal force.

The eccentric cam 6C is fitted with a third roller bearing 29, washers 27, 28 at opposite ends thereof, a bearing bush 30 and a drive shoe 31.

The portion of the pump housing member 3 opposite the drive shoe 31 is provided with cylinder barrels 32, pistons 33 and plugs 34 which are disposed radially within a plane perpendicular to the axis of the pump shaft 6. The pistons 33 are urged into contact with the drive shoe 31 by the force of piston springs 35 provided inside the cylinder barrels 32.

Gasoline or other low-viscosity fuel is supplied to the intake passage 7 from a fuel tank 36 by a feed pump 37 and is discharged through the discharge passage 9 by the pump action of the eccentric cam 6C to be sprayed from a fuel injection nozzle 38. Fuel overflowing from the overflow passage 8 is returned to the fuel tank 36 through a check valve 39.

The fuel paths within the cover 2 and the pump housing member 3 will now be explained in detail.

The fuel from the intake passage 7 passes through a first bush hole 40 in the first bearing bush 20 into an annular chamber 41 surrounding the eccentric cam 6C. It then passes through a second bush hole 42 in the second bearing bush 24 into a coupling chamber 43, thus reaching the intake-side passages 44 (only one shown).

FIG. 8 is a perspective view schematically showing a fuel path extending from an intake-side passage 44 through a cylinder barrel 32 and a discharge-side passage 45 to the discharge passage 9. The leaf valve member 5 is formed within one and the same plane with overflow ports 46, intake valves 47 and discharge valves 48 (only one of each shown).

As shown in FIG. 8, the overflow port 46 is communicated with the intake-side passage 44 formed in the pump housing member 3 and is communicated with the intake valve 47 through a first communicating passage 49 formed in the cover 2 and is further communicated with an intake/discharge window 51 in the cylinder barrel 32 through a second communicating passage 50 formed in the pump housing member 3.

The intake/discharge window 51 communicates with a pressurization chamber 53 (also see FIG. 7) through an intake/discharge port 52 of the piston 33.

Fuel discharged by the action of the piston 33 passes from the intake/discharge window 51, through the discharge-side passage 45 formed in the pump housing member 3 and the discharge valve 48 to the discharge passage 9.

The area of the overflow port 46 is determined to overflow a prescribed percentage of the fuel from the intake-side passage 44.

Since the intake valves 47 can bend only in the direction of fuel intake, the fuel is able to flow in the intake direction from the first communicating passages 49 to the second communicating passages 50.

Since the discharge valves 48 can bend only in the fuel discharge direction, the fuel is able to flow in the discharge direction from the discharge-side passages 45 to the discharge passage 9.

In the radial piston pump for low-viscosity fuel 1 configured in the foregoing manner, when the pistons 33 move centripetally during the intake stroke (when the piston 33 shown in FIG. 8 moves downward), a part of the fuel from the intake-side passage 44 overflows through the overflow port 46 to the overflow passage 8, while the intake valves 47 allow the remainder thereof to pass through the first communicating passages 49, the second communicating passage 50, the intake/discharge window 51 and the intake/discharge port 52 into the pressurization chambers 53. The discharge valves 48 are closed during the intake stroke.

When the pistons 33 move centrifugally during the discharge stroke (when the piston 33 shown in FIG. 8 moves upward), the pressurization effect of the pressurization chambers 53 and the discharge effect of the discharge valves 48 act to discharge the fuel through the intake/discharge ports 52, the intake/discharge windows 51, the discharge-side passages 45 and the discharge valves 48 to the discharge passage 9. The intake valves 47 are closed during the discharge stroke.

As explained in the foregoing, the fuel fed in through the intake passage 7 passes through the annular chamber 41 housing the eccentric cam 6C of the pump shaft 6 and the coupling chamber 43 housing the magnetic coupling 13 and a portion thereof is overflowed to the overflow passage 8 for recirculation. Since the fuel therefore passes through the parts of the bearings where sliding friction occurs before being pressurized and discharged by the action of the pistons 33, the bearings can be adequately lubricated and cooled at the same time that the fuel is being sucked in and discharged.

Moreover, since the overflow ports 46, intake valves 47 and discharge valves 48 which produce the overflow, intake and discharge actions are formed within the same plane of the leaf valve member 5, the radial piston pump for low-viscosity fuel 1 is easier to assemble and can be assembled with higher precision than a radial piston pump for low-viscosity fuel in which these members are not in the same plane. This feature also makes it possible to reduce the length of the radial piston pump for low-viscosity fuel 1 in the axial direction of the pump shaft 6.

Other features of the radial piston pump for low-viscosity fuel 1 also contribute to overall size reduction. For example, since the overflow passage 8 which communicates directly with the overflow port 46, the intake passage 7 through which fuel reaches the intake valves 47 and the discharge passage 9 which communicates directly with the discharge-side passages 45 can be formed in the cover 2, portions of the radial piston pump for low-viscosity fuel 1 that would otherwise project radially can be eliminated. The need to provide tubing on the outer surface of the radial piston pump for low-viscosity fuel 1 is also eliminated.

Owing to the provision of the magnetic coupling 13, the radial piston pump 1 configured in the foregoing manner exhibits better fuel seal performance than a conventional radial piston pump. On the other hand, however, it entails the risk that wear of sliding contact portions on the side of the driven-side shaft 6B, such as at the inner and outer peripheral portions of the second roller bearing 23 where rotational sliding occurs, may lead to contact between the magnetic coupling 13 and the partition 12 and, in turn, to leakage of fuel to the exterior of the radial piston pump 1.

More specifically, since the magnetic coupling 13 comprises the drive-side yoke 14A and the driven-side yoke 15A which extend in a plane perpendicular to the axis of the pump shaft 6 and are provided on their outer peripheries with the drive-side magnet 14B and the driven-side magnet 15B of a prescribed thickness or length in the axial direction of the pump shaft 6, any tilting of the axis of the pump shaft 6 owing to wear of the sliding contact portions may allow the driven-side yoke 15A and/or the driven-side magnet 15B to contact and abrade the partition 12, thereby allowing the low-viscosity fuel to leak from the coupling chamber 43 to the outside of the radial piston pump 1.

Abrasion of the partition 12 by the drive-side yoke 14A and the drive-side magnet 14B of the magnetic coupling 13 may also occur similarly on the opposite side of the partition 12 from the coupling chamber 43 if wear occurs at the sliding contact portion of the drive-side shaft 6A between the pump housing member 3 and the third pump housing member (the flange 4), specifically at the portion of the ball bearing 17.

Therefore, if contact of the magnetic coupling 13 with the partition 12 should cause abnormal rotation of the radial piston pump for low-viscosity fuel 1, the delivery of pressurized fuel has to be stopped.

Moreover, this is an intrinsic structural problem of the magnetic coupling 13 which arises irrespective of whether the partition 12 is formed in a prescribed bent shape relative to the axial direction of the pump shaft 6, as shown in FIG. 7, or is formed to extend along a straight line perpendicular to the axial direction thereof.

This invention was accomplished in light of the foregoing problems of the prior art and has as one of its objects to provide a radial piston pump for low-viscosity fuel with an improved fuel leakage prevention structure or fuel seal structure which prevents leakage of low-viscosity fuel by obviating the possibility of damage to the partition even if wear should occur at the sliding contact portions of the pump shaft.

Another object of the invention is to provide a radial piston pump for low-viscosity fuel which terminates the transmission of torque to the pump shaft when the magnetic coupling contacts the pump housing before contacting the partition, thereby enabling the rotation of the pump shaft to be stopped before leakage occurs.

Another object of the invention is to provide a radial piston pump for low-viscosity fuel which enables the degree or state of contact between the magnetic coupling and the pump housing to be regulated or set.

SUMMARY OF THE INVENTION

The present invention achieves these objects by enabling regulation of a first larger clearance between the magnetic coupling portion and the partition and a second smaller clearance between the magnetic coupling portion and the pump housing.

The first aspect of the invention provides a radial piston pump for low-viscosity fuel comprising a pump housing formed with intake-side fuel passages and discharge-side fuel passages, a plurality of pistons disposed radially within the pump housing to be capable of reciprocation, a pump shaft formed with an eccentric cam for reciprocating the pistons and divided into a drive-side shaft and a driven-side shaft, a partition provided between the drive-side shaft and the driven-side shaft of the pump shaft to shut off an interior portion of the pump housing including the intake-side passages and the discharge-side passages from portions exterior thereof, and a magnetic coupling provided to straddle the partition between the drive-side shaft and the driven-side shaft of the pump shaft, reciprocation of the pistons causing low-viscosity fuel to be sucked in through the intake-side passages and discharged through the discharge-side passages, the radial piston pump for low-viscosity fuel being characterized in that a first clearance established between the magnetic coupling and the partition is made larger than a second clearance established between the magnetic coupling and the pump housing.

A second aspect of the invention provides a radial piston pump for low-viscosity fuel comprising a pump housing formed with intake-side fuel passages and discharge-side fuel passages, a plurality of pistons disposed radially within the pump housing to be capable of reciprocation, a pump shaft formed with an eccentric cam for reciprocating the pistons and divided into a drive-side shaft and a driven-side shaft, a partition provided between the drive-side shaft and the driven-side shaft of the pump shaft to shut off an interior portion of the pump housing including the intake-side passages and the discharge-side passages from portions exterior thereof, and a magnetic coupling provided to straddle the partition between the drive-side shaft and the driven-side shaft of the pump shaft, reciprocation of the pistons causing low-viscosity fuel to be sucked in through the intake-side passages and discharged through the discharge-side passages, the radial piston pump for low-viscosity fuel being characterized in that a clearance setting means capable of setting a clearance between the magnetic coupling and the pump housing is provided on one or both of the magnetic coupling and the pump housing.

The clearance setting means can be a clearance setting projection which projects from the magnetic coupling toward the pump housing or from the pump housing toward the magnetic coupling.

Since the invention provides the radial piston pump for low-viscosity fuel with a clearance extending over a prescribed range between the magnetic coupling and the pump housing, leakage of low-viscosity fuel can be reliably prevented by eliminating the risk of contact between the drive-side coupling member or the driven-side coupling member and the partition at the magnetic coupling portion even if wear should occur at the sliding contact portions of the pump shaft.

According to the first aspect of the invention, since the first clearance established between the magnetic coupling and the partition is made larger than the second clearance established between the magnetic coupling and the pump housing, abnormal operation arising in the magnetic coupling portion owing to wear of the sliding contact portions of the pump shaft results in contact of the magnetic coupling with the pump housing, not with the partition. As a result, the transmission of torque through the magnetic coupling can be terminated and leakage of fuel owing to damage to the partition prevented, while, moreover, the operation of the radial piston pump for low-viscosity fuel can be gradually stopped.

According to the second aspect of the invention, since a clearance setting means capable of setting a clearance between the magnetic coupling and the pump housing is provided on one or both of the magnetic coupling and the pump housing, it is possible to adjust the point in the progressive axial deviation of the pump shaft with wear of its sliding contact portions at which the radial piston pump for low-viscosity fuel is stopped.

DETAILED DESCRIPTION OF THE PREFERRED EMBODIMENTS

Figure 7:
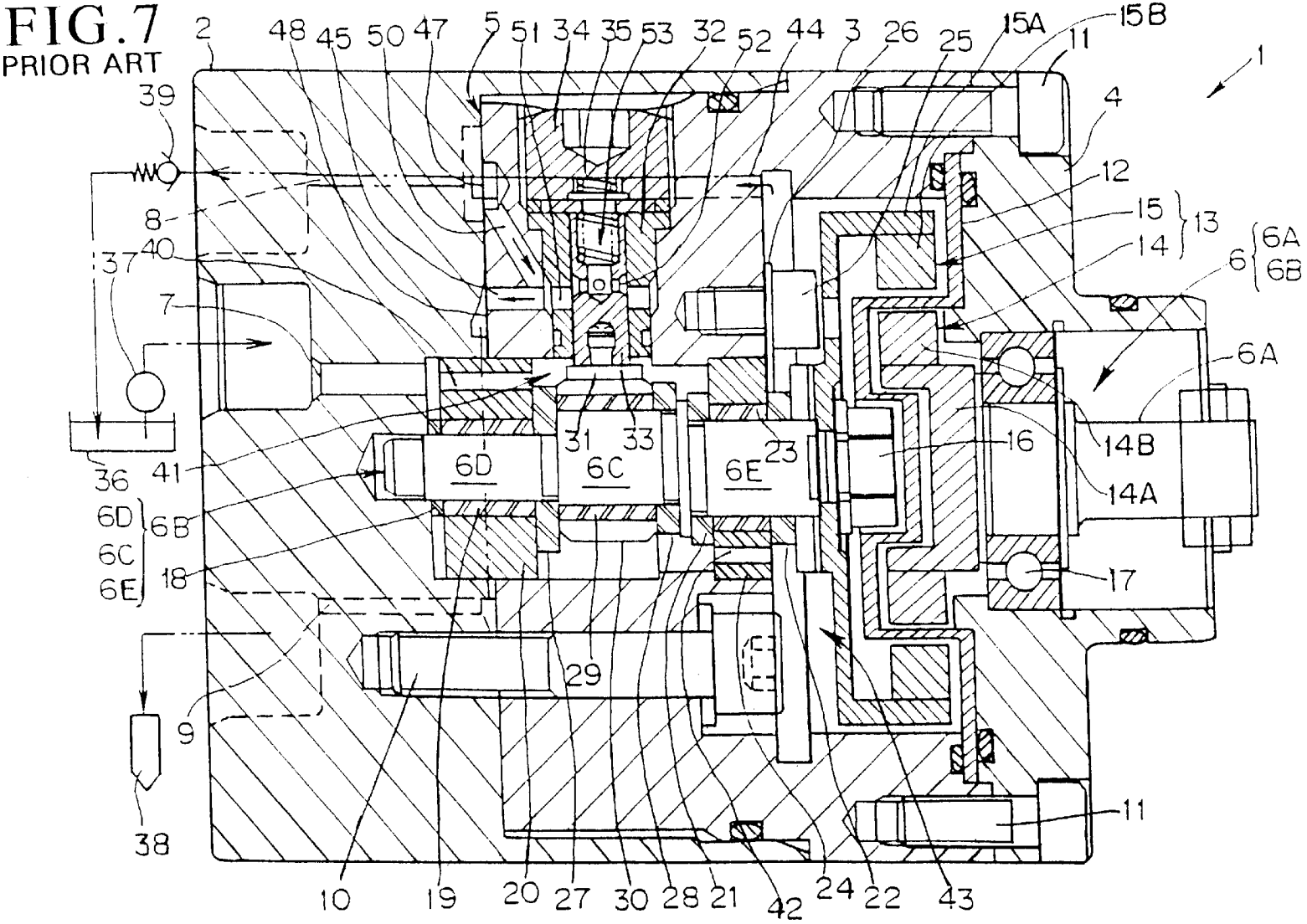
FIG. 7 PRIOR ART
FIG. 7 is a sectional view of a prior-art radial piston pump for low-viscosity fuel 1 having a magnetic coupling 13.
Figure 8:
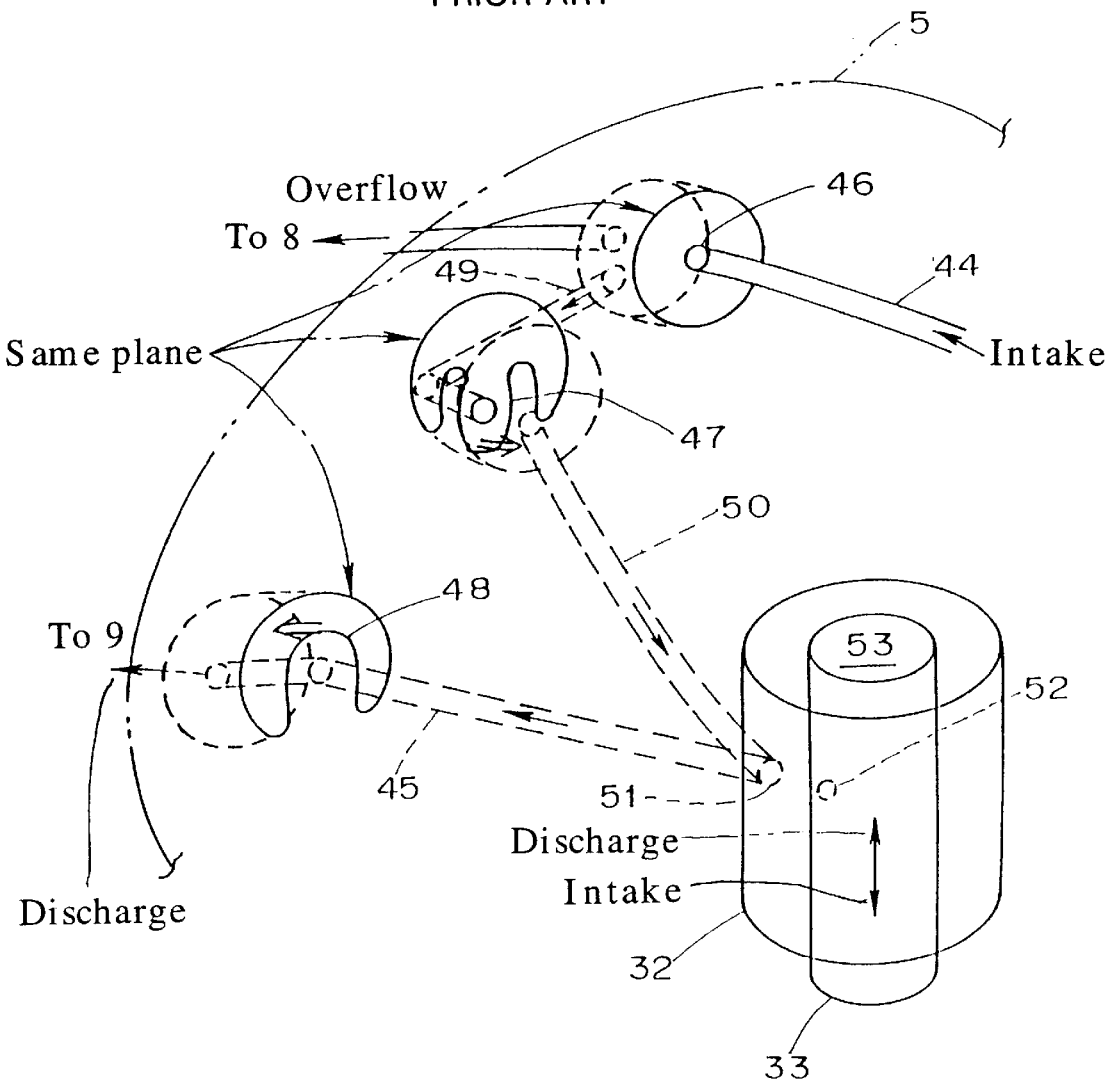
FIG. 8 PRIOR ART
FIG. 8 is a perspective view schematically showing a fuel path extending from an intake-side passage 44 through a cylinder barrel 32 and a discharge-side passage 45 to a discharge passage 9 in the radial piston pump for low-viscosity fuel 1 of FIG. 7.

An embodiment of the radial piston pump for low-viscosity fuel according to the first aspect of the invention will be explained with reference to FIGS. 1 to 3, in which portions similar to those in FIGS. 7 and 8 are assigned the same reference symbols as those in FIGS. 7 and 8 and will not be described further.

Figure 1:
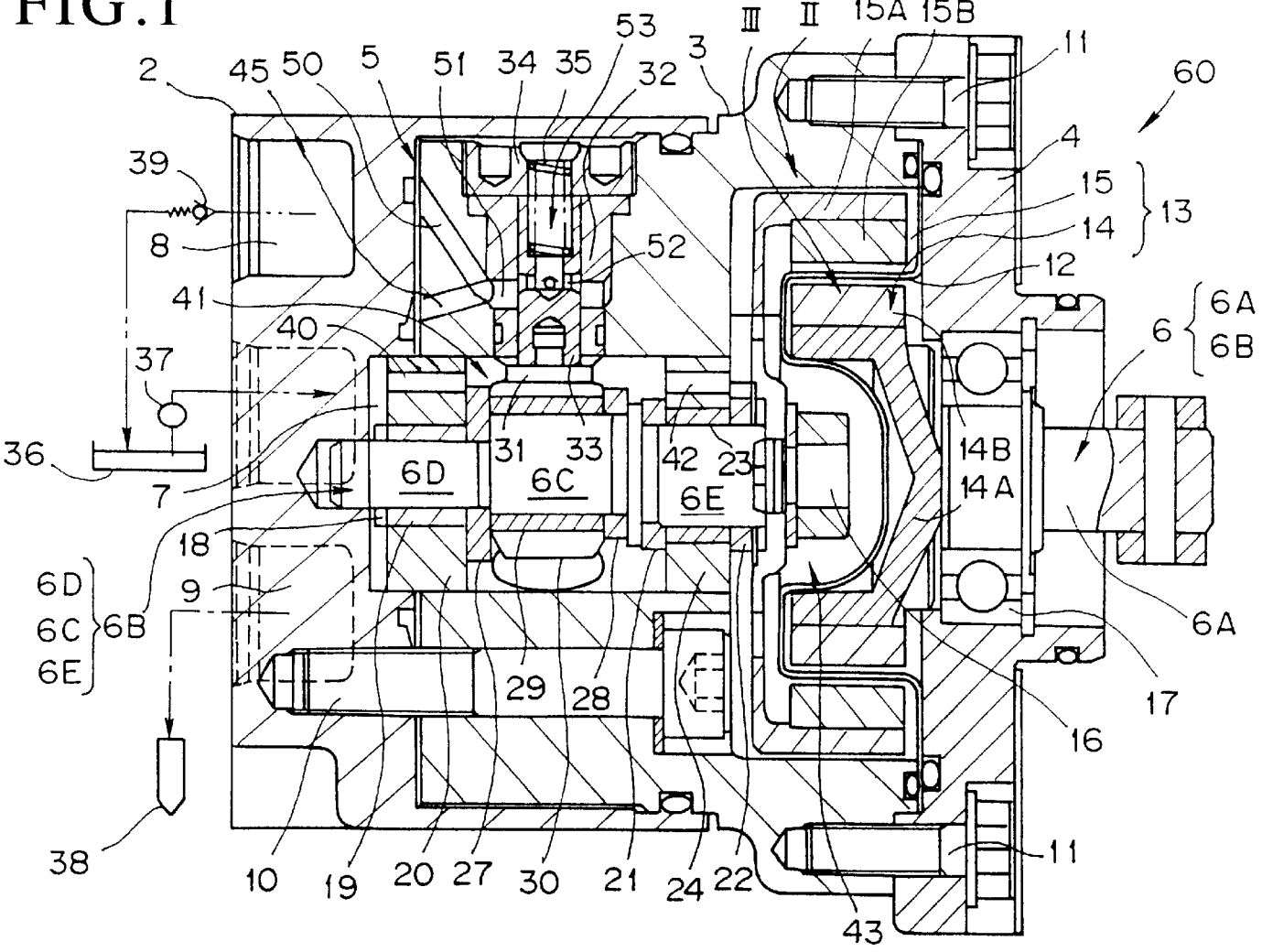
FIG. 1 is a sectional view of a radial piston pump for low-viscosity fuel 60 which is an embodiment of the first aspect of the invention.

FIG. 1 is a sectional view of a radial piston pump for low-viscosity fuel 60 which is an embodiment of the first aspect of the invention; FIG. 2 is an enlarged view of the portion marked II in FIG. 1; and FIG. 3 is an enlarged view of the portion marked III in FIG. 1. The radial piston pump for low-viscosity fuel 60 differs in structure from the radial piston pump for low-viscosity fuel 1 of FIG. 7 only as regards the magnetic coupling 13 portion shown in FIGS. 2 and 3. The following explanation focuses on this portion.

Figure 2:
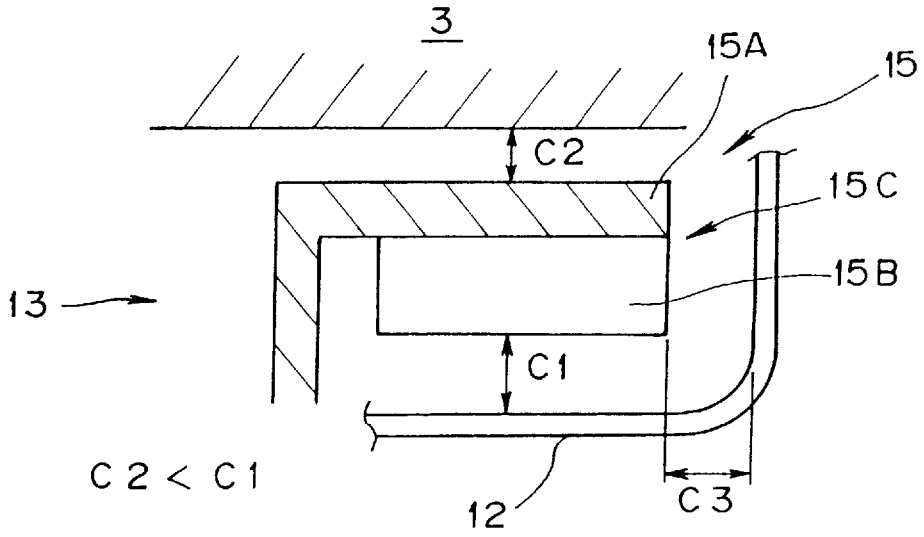
FIG. 2 is an enlarged view of the portion marked II in FIG. 1.

As shown in FIG. 2, a first clearance C1 is established in a direction perpendicular to the axis of the pump shaft 6 between the partition 12 and the driven-side magnet 15B of the magnetic coupling 13, and a second clearance C2 is established in the same direction between the pump housing member 3 and the driven-side yoke 15A. The first clearance C1 is made larger than the second clearance C2.

Therefore, when wear of sliding contact portions of the pump shaft 6 causes the rotational axis of the pump shaft 6, particularly that at the housing-side support section 6E (FIG. 7), to deviate from normal, thus causing the end portion of the driven-side coupling member 15 to deviate from its normal rotational plane, the driven-side coupling member 15 (the driven-side yoke 15A) first makes contact with the pump housing member 3. The rotation of the driven-side shaft 6B is therefore stopped by the engagement of the driven-side coupling member 15 with the pump housing member 3 before the driven-side coupling member 15 (driven-side magnet 15B) makes contact with the partition 12.

The clearance in the axial -direction of the pump shaft 6 between the end face 15C of the driven-side coupling member 15 and the partition 12 (the clearance designated as C3 in FIG. 2) has no direct connection with the transmission of power between the drive-side magnet 14B and the driven-side magnet 15B and can be set to any desired size equal to or larger than that of the first clearance C1.

Figure 3:
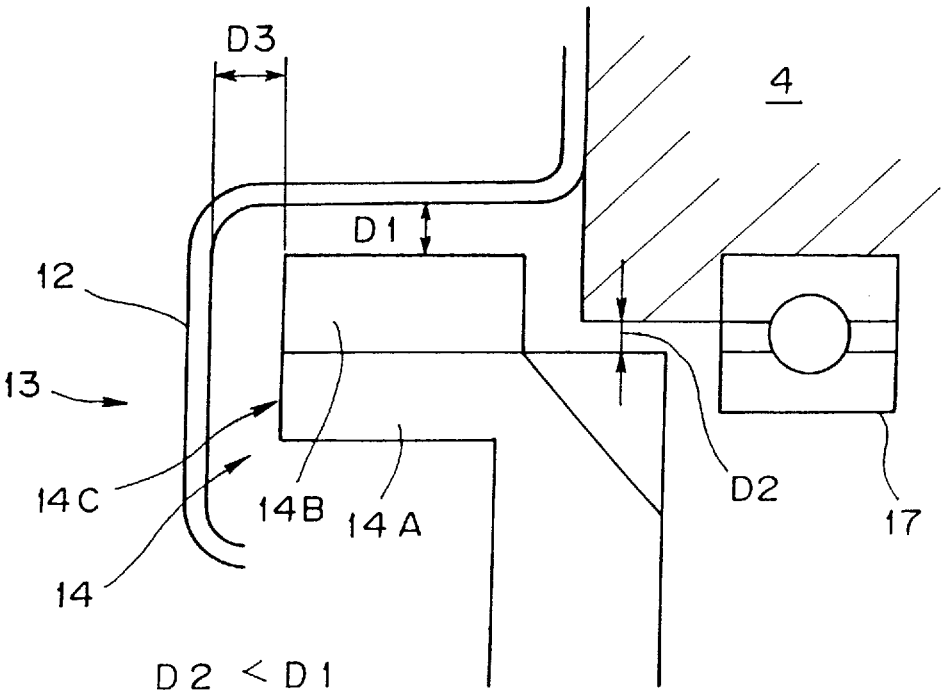
FIG. 3 is an enlarged view of the portion marked III in FIG. 1.

As shown in FIG. 3, a first clearance D1 is established in a direction perpendicular to the axis of the pump shaft 6 between the partition 12 and the drive-side magnet 14B of the magnetic coupling 13, and a second clearance D2 is established in the same direction between the pump housing (flange 4) and the drive-side yoke 14A. The first clearance D1 is made larger than the second clearance D2.

Therefore, when wear of sliding contact portions of the pump shaft 6 causes the rotational axis of the pump shaft 6, particularly that at the drive-side shaft 6A, to deviate from normal, thus causing the end portion of the drive-side coupling member 14 to deviate from its normal rotational plane, the drive-side coupling member 14 (the drive-side yoke 14A) first makes contact with the flange 4. The rotation of the drive-side shaft 6A is therefore stopped by the engagement of the drive-side coupling member 14 with the flange 4 before the drive-side coupling member 14 (drive-side magnet 14B) makes contact with the partition 12.

The clearance in the axial direction of the pump shaft 6 between the end face 14C of the drive-side coupling member 14 and the partition 12 (the clearance designated as D3 in FIG. 3) has no direct connection with the transmission of power between the drive-side magnet 14B and the driven-side magnet 15B and can be set to any desired size equal to or larger than that of the first clearance D1.

Figure 4:
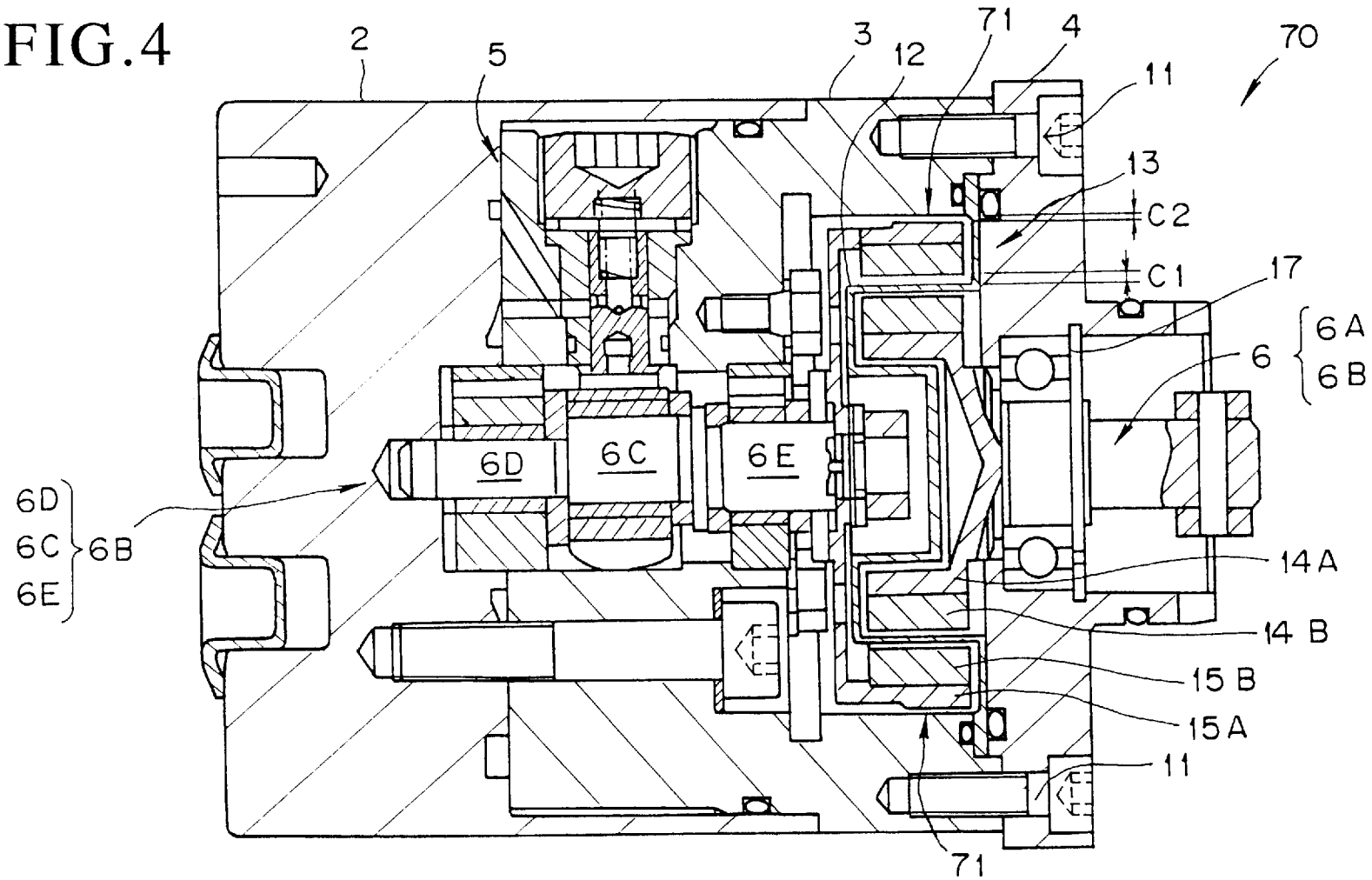
FIG. 4 is a sectional view of a radial piston pump for low-viscosity fuel 70 which is an embodiment of the second aspect of the invention.
Figure 5:
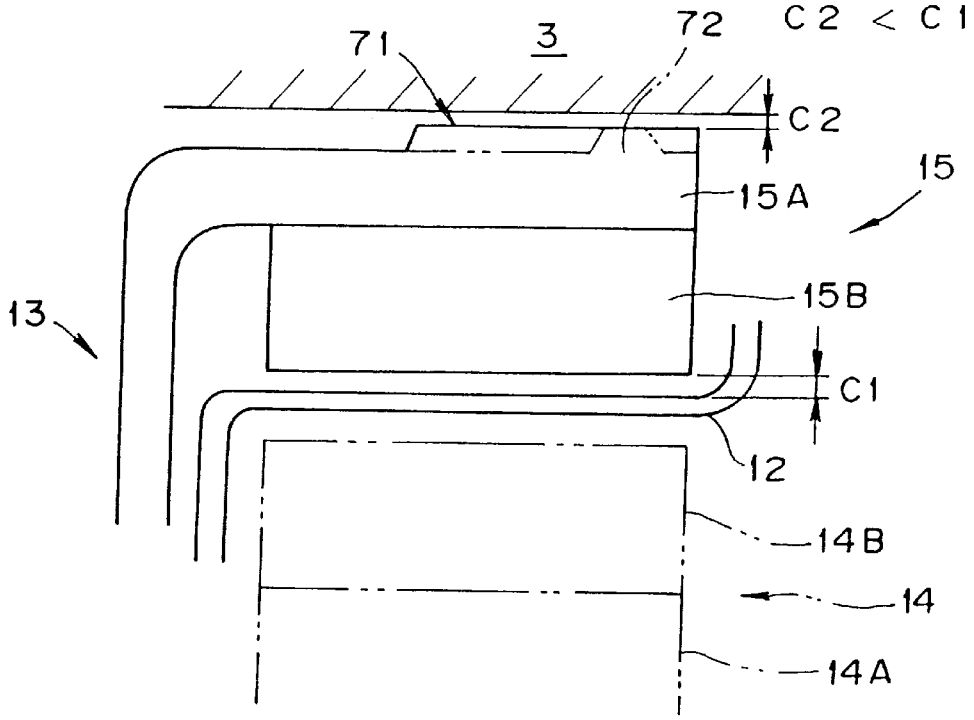
FIG. 5 is an enlarged view of an essential portion of the magnetic coupling 13 of the radial piston pump for low-viscosity fuel 70.

FIG. 4 is a sectional view of a radial piston pump for low-viscosity fuel 70 which is an embodiment of the second aspect of the invention and FIG. 5 is an enlarged view of an essential portion of the magnetic coupling 13 of the radial piston pump for low-viscosity fuel 70. In the radial piston pump for low-viscosity fuel 70, the driven-side yoke 15A is provided over its full periphery on the side facing the pump housing member 3 with a clearance setting projection 71 (clearance setting means) which projects toward the pump housing member 3.

Similarly to in the first aspect of the invention, a first clearance C1 is established in a direction perpendicular to the axis of the pump shaft 6 between the partition 12 and the driven-side magnet 15B of the magnetic coupling 13, and a second clearance C2 is established in the same direction between the pump housing member 3 and the clearance setting projection 71 of the driven-side yoke 15A. The first clearance C1 is again made larger than the second clearance C2.

By regulating the projection height of the clearance setting projection 71 (and thus the size of the second clearance C2) at the time of designing the radial piston pump for low-viscosity fuel 70, it is possible to regulate at what point in the course of the wear of the sliding contact portion of the pump shaft 6 the driven-side coupling member 15 (the driven-side yoke 15A) makes contact with the pump housing member 3.

As shown by a phantom line in FIG. 5, the clearance setting projection 71 extending over the full periphery of the driven-side yoke 15A can be replaced by a plurality of shorter clearance setting projections 72 disposed discontinuously within a prescribed peripheral region of the driven-side yoke 15A.

Figure 6:
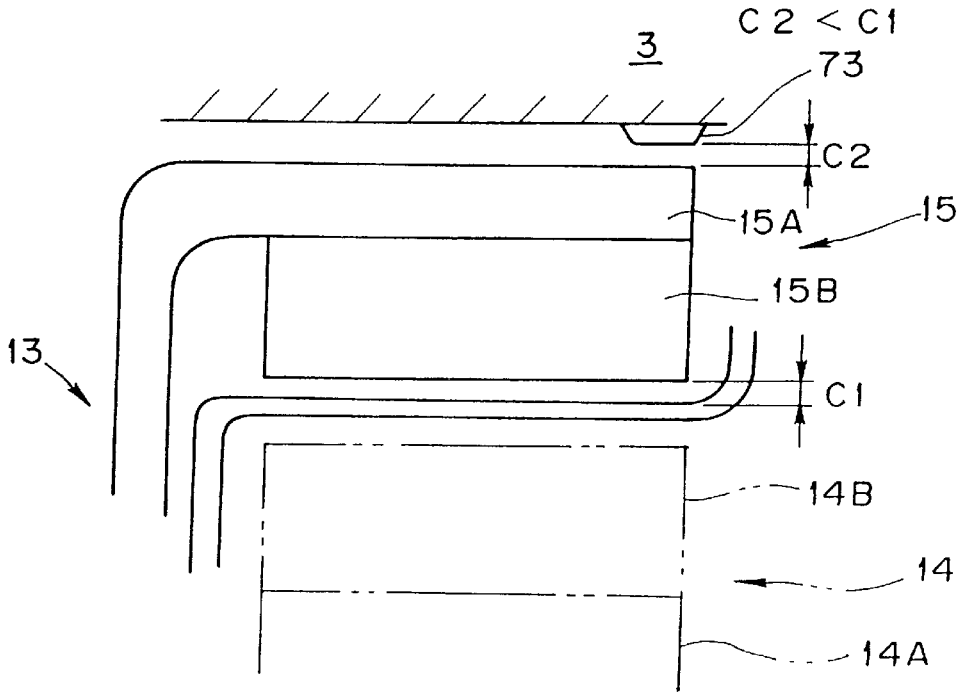
FIG. 6 is an enlarged view of an essential portion of the magnetic coupling 13 of the radial piston pump for low-viscosity fuel 70 showing another configuration of a clearance setting means.

FIG. 6 is an enlarged view of an essential portion of the magnetic coupling 13 showing another configuration of a clearance setting means in which a clearance setting projection 73 is formed to project from the side of the pump housing member 3 toward the magnetic coupling 13 (the driven-side yoke 15A of the driven-side coupling member 15).

Similarly to the earlier embodiments, a first clearance C1 is established in a direction perpendicular to the axis of the pump shaft 6 between the partition 12 and the driven-side magnet 15B of the magnetic coupling 13, and a second clearance C2 is established in the same direction between the clearance setting projection 73 of the pump housing member 3 and the driven-side yoke 15A. The first clearance C1 is again made larger than the second clearance C2.

This configuration also prevents damage to the partition 12 when wear of the sliding contact portions of the pump shaft 6 causes the driven-side coupling member 15 to wobble during rotation since the wobbly driven-side coupling member 15 comes into contact with the clearance setting projection 73 before it can make contact with the partition 12. Another advantage of this embodiment is that by adopting the clearance setting projection 73 it becomes possible to use a conventional magnetic coupling 13 without need for any modification.

In the radial piston pump for low-viscosity fuel according to this invention, therefore, wear of the sliding contact portions of the pump shaft 6 causes contact between the pump housing member 3 and the driven-side coupling member 15 or between the flange 4 and the drive-side coupling member 14, whereby the rotation of the driven-side shaft 6B is gradually stopped. As a result, the delivery of pressurized fuel is stopped, the partition 12 is protected and the leakage of the low-viscosity fuel is prevented.

In this invention it suffices to make the first clearance between the magnetic coupling 13 and the partition 12 larger than the second clearance between the magnetic coupling 13 and the pump housing member 3 so as to ensure that when the magnetic coupling 13 begins to wobble it makes contact with the pump housing (pump housing member 3 and/or flange 4) before making contact with the partition 12. This principle applies irrespective of whether the partition 12 is formed in a prescribed bent shape relative to the axial direction of the pump shaft 6, as shown in FIGS. 1, 4 or 7, or is formed to extend along a straight line perpendicular to the axial direction thereof.

As explained in the foregoing, the larger clearance provided between the magnetic coupling and the partition according to this invention serves to protect the partition from damage and thereby prevents leakage of the low-viscosity fuel. Moreover, since the wear of the sliding contact portions of the pump shaft and the like progress gradually, any trouble arising in the radial piston pump because of such wear is not likely to lead to a major problem such as a road breakdown of the vehicle equipped with the radial piston pump.

What is claimed is:

1. A radial piston pump for low-viscosity fuel comprising:

a pump housing formed with intake-side fuel passages and discharge-side fuel passages, a plurality of pistons disposed radially within the pump housing for reciprocation radially within the housing, the pistons being selectively in communication with the intake-side fuel passages and the discharge-side fuel passages, a rotatable pump shaft having an eccentric cam thereon for reciprocating the pistons as the pump shaft and the cam are rotated and the pump shaft is divided into a drive-side shaft and a driven-side shaft, the cam being on the driven-side shaft, wherein reciprocation of the pistons by the cam causes low-viscosity fuel to be sucked in through the intake-side passages and discharged through the discharge-side passages, a partition between the drive-side shaft and the driven-side shaft of the pump shaft to shut off an interior portion of the pump housing including the intake-side passages and the discharge-side passages, the driven-side shaft, the cam and the pistons from portions of the pump housing exterior to the interior portion and from the drive-side shaft, and a magnetic coupling straddling the partition between the drive-side shaft and the driven-side shaft of the pump shaft, the magnetic coupling comprising a driven-side magnet on the driven-side shaft and toward the partition, and a driven-side support yoke toward the housing on which the driven-side magnet is supported, and comprising a drive-side magnet on the drive-side shaft and toward the partition, and a drive-side yoke toward the pump housing and on which the drive-side magnet is supported; the magnets and their yokes being so positioned in the housing that in a direction perpendicular to an axis of the pump shaft between the partition and the driven-side magnet:

a first clearance is established in the direction perpendicular to the axis of the pump shaft between the driven-side magnet and the partition;

a second clearance is established in the direction perpendicular to the axis of the pump shaft between the pump housing and the driven-side yoke;

a third clearance is established in the direction perpendicular to the axis of the pump shaft between the partition and the drive-side magnet;

a fourth clearance is established in the direction perpendicular to the axis of the pump shaft between the pump housing and the drive-side yoke; and so that the first and third clearances to the partition are larger than the second and fourth clearances to the pump housing.

2. A radial piston pump for low-viscosity fuel according to claim 1, wherein the driven-side magnet and the driven-side yoke have a first axial end face away from the cam, the partition also extends radially outward past and is spaced away from the first end face, such that a fifth clearance is established between the first end face and the partition passing thereby, and the fifth clearance is equal to or larger than the first clearance;

the drive-side magnet and the drive-side yoke have a second axial end face also away from the cam, the partition also extends radially outward past and is spaced away from the second end face such that a sixth clearance is established between the second end face and the partition passing thereby, and the sixth clearance is equal to or larger than the third clearance.

3. A radial piston pump for low-viscosity fuel according to claim 2, wherein the partition has a portion extending parallel to an axial direction of the pump shaft which is between the driven-side and the drive-side magnets and a portion extending perpendicular to the axial direction of the pump shaft which passes by the first and second end faces.

4. A radial piston pump for low-viscosity fuel comprising:

a pump housing formed with intake-side fuel passages and discharge-side fuel passages, a plurality of pistons disposed radially within the pump housing for reciprocation radially within the housing, the pistons being selectively in communication with the intake-side fuel passages and the discharge-side fuel passages, a rotatable pump shaft having an eccentric cam thereon for reciprocating the pistons as the pump shaft and the cam are rotated and the pump shaft is divided into a drive-side shaft and a driven-side shaft, the cam being on the driven-side shaft, wherein reciprocation of the pistons by the cam causes low-viscosity fuel to be sucked in through the intake-side passages and discharged through the discharge-side passages, a partition between the drive-side shaft and the driven-side shaft of the pump shaft to shut off an interior portion of the pump housing including the intake-side passages and the discharge-side passages, the driven-side shaft, the cam and the pistons from portions of the pump housing exterior to the interior portion and from the drive-side shaft, and a magnetic coupling straddling the partition between the drive-side shaft and the driven-side shaft of the pump shaft, and clearance setting means for setting a clearance between the magnetic coupling and the pump housing provided on one or both of the magnetic coupling and the pump housing.

5. A radial piston pump for low-viscosity fuel according to claim 4, wherein the clearance setting means is a clearance setting projection projecting from the magnetic coupling toward the pump housing or from the pump housing toward the magnetic coupling.

6. A radial piston pump for low-viscosity fuel according to claim 4, wherein the clearance setting means is provided completely around the magnetic coupling or the pump housing.

7. A radial piston pump for low-viscosity fuel according to claim 4, wherein the clearance setting means is provided on the magnetic coupling or the pump housing independently or discontinuously.

8. A radial piston pump for low-viscosity fuel according to claim 4, wherein a first clearance established between the magnetic coupling and the partition is made larger than a second clearance established between the pump housing and the clearance setting means.

9. A pump for low-viscosity fuel comprising:

a pump housing formed with intake-side fuel passages and discharge-side fuel passages, fuel pressurization means disposed within the pump housing, a rotatable pump shaft having an eccentric cam thereon for operating the fuel pressurization means as the pump shaft and the cam are rotated, the pump shaft is divided into a drive-side shaft and a driven-side shaft, the cam being on the driven-side shaft, wherein operation of the fuel pressurization means by the cam causes low-viscosity fuel to be sucked in through the intake-side passages and discharged through the discharge-side passages, a partition between the drive-side shaft and the driven-side shaft of the pump shaft to shut off an interior portion of the pump housing including the intake-side passages and the discharge-side passages, the driven-side shaft, the cam and the pistons from portions of the pump housing exterior to the interior portion and from the drive-side shaft, and a magnetic coupling straddling the partition between the drive-side shaft and the driven-side shaft of the pump shaft, the magnetic coupling comprising a driven-side magnet on the driven-side shaft and toward the partition and a driven-side support yoke and toward the housing on which the driven-side magnet is supported, and comprising a drive-side magnet on the drive-side shaft and toward the partition and a drive-side yoke toward the pump housing and on which the drive-side magnet is supported; the magnets and their yokes being so positioned in the housing that in a direction perpendicular to an axis of the pump shaft between the partition and the driven-side magnet:

a first clearance is established in the direction perpendicular to the axis of the pump shaft between the driven-side magnet and the partition, a second clearance is established in the direction perpendicular to the axis of the pump shaft between the pump housing and the driven-side yoke;

a third clearance is established in the direction perpendicular to the axis of the pump shaft between the partition and the drive-side magnet;

a fourth clearance is established in the direction perpendicular to the axis of the pump shaft between the pump housing and the drive-side yoke; and so that the first and third clearances to the partition are larger than the second and fourth clearances to the pump housing.

10. A pump for low-viscosity fuel comprising:

a pump housing formed with intake-side fuel passages and discharge-side fuel passages, fuel pressurization means disposed within the pump housing, a rotatable pump shaft having a cam thereon for operating the fuel pressure means as the pump shaft and the cam are rotated, the pump shaft is divided into a drive-side shaft and a driven-side shaft, the cam being on the driven-side shaft, a partition between the drive-side shaft and the driven-side shaft of the pump shaft to shut off an interior portion of the pump housing, including the intake-side passages and the discharge-side passages and the driven-side shaft, from portions of the pump housing exterior to the interior portion and from the drive-side shaft, and a magnetic coupling straddling the partition between the drive-side shaft and the driven-side shaft of the pump shaft, operation of the fuel pressurization means causing low-viscosity fuel to be sucked in through the intake-side passages and discharged through the discharge-side passages, a clearance setting means for setting a clearance between the magnetic coupling and the pump housing being provided on one or both of the magnetic coupling and the pump housing.

11. A radial piston pump for low-viscosity fuel comprising:

a pump housing formed with intake-side fuel passages and discharge-side fuel passages, a plurality of pistons disposed radially within the pump housing for reciprocation radially within the housing, the pistons being selectively in communication with the intake-side fuel passages and the discharge-side fuel passages, a rotatable pump shaft having an eccentric cam thereon for reciprocating the pistons as the pump shaft and the cam are rotated and the pump shaft is divided into a drive-side shaft and a driven-side shaft, the cam being on the driven-side shaft, wherein reciprocation of the pistons by the cam cause low-viscosity fuel to be sucked in through the intake-side passages and discharged through the discharge-side passages, a partition between the drive-side shaft and the driven-side shaft of the pump shaft to shut off an interior portion of the pump housing including the intake-side passages and the discharge-side passages, the driven-side shaft, the cam and the pistons from portions of the pump housing exterior to the interior portion and from the drive-side shaft, and a magnetic coupling straddling the partition between the drive-side shaft and the driven-side shaft of the pump shaft, the magnetic coupling comprising a driven-side magnet on the driven-side shaft and toward the partition, and a driven-side support yoke toward the housing on which the driven-side magnet is supported, and comprising a drive-side magnet on the drive-side shaft and toward the partition, and a drive-side yoke toward the pump housing and on which the drive-side magnet is supported; the magnets and their yokes being so positioned in the housing that in a direction perpendicular to an axis of the pump shaft between the partition and the driven-side magnet:

a first clearance is established in the direction perpendicular to the axis of the pump shaft between the drive-side magnet and the partition larger than a second clearance established between the magnetic coupling and the pump housing.

a second clearance is established in the direction perpendicular to the axis of the pump shaft between the pump housing and the drive-side yoke and so that the first clearance is larger than the second clearance.

* * * * *